United States Patent [19]

Stakofsky

[11] 4,161,975

[45] Jul. 24, 1979

[54] HANDBAG CONSTRUCTION AND METHOD THEREFORE

[76] Inventor: Charles Stakofsky, 1660 E. New York Ave., Brooklyn, N.Y. 11212

[21] Appl. No.: 863,742

[22] Filed: Dec. 23, 1977

[51] Int. Cl.[2] ..... A45C 13/26

[52] U.S. Cl. ..... 150/33; 150/29

[58] Field of Search ..... 150/29, 33, 28 R; D87/3 F; 190/57, 49; 292/70; 224/45

[56] References Cited

U.S. PATENT DOCUMENTS

| | | | |
|---|---|---|---|
| D. 107,508 | 12/1937 | Felmann | D87/3 F |
| D. 246,940 | 1/1978 | Sabol | D87/3 F |
| 1,361,761 | 12/1920 | Gay | 150/29 |
| 2,036,645 | 4/1936 | Schell | 150/33 |
| 2,857,949 | 10/1958 | Ziff | 150/29 |
| 3,912,141 | 10/1975 | Appel | 150/33 |

FOREIGN PATENT DOCUMENTS

| | | | |
|---|---|---|---|
| 736510 | 11/1932 | France | 150/33 |
| 999286 | 1/1952 | France | 150/29 |
| 1211830 | 10/1959 | France | 150/33 |

*Primary Examiner*—Ro E. Hart

*Attorney, Agent, or Firm*—Richard L. Miller

[57] ABSTRACT

A handbag having a cuff stitched to each end of a strap of the handbag, so that the cuff drapes shirt-like over the strap and bag connection so to attractively hide the connection; and a method whereby this construction is accomplished; the method including stitching the cuff inside out around and intermediate position of the strap and thereafter pulling cuff outside in so to draw it over the strap end and bag connection.

1 Claim, 8 Drawing Figures

10
11
12
13
14
15
16
17
18
19
20
21
22
23
24
28
29
2
4

HANDBAG CONSTRUCTION AND METHOD THEREFORE

This invention relates generally to handbags and the construction thereof.

A principle object of the present invention is to provide a handbag construction that includes an attractive appearing junction between the handbag body and the bag straps.

Another object is to provide a handbag construction wherein the bag and strap connection is hidden from view under a decorative cuff.

Yet another object is to provide a method or process by which the cuff is incorporated in the handbag manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4, 5, 6, 7, 8:
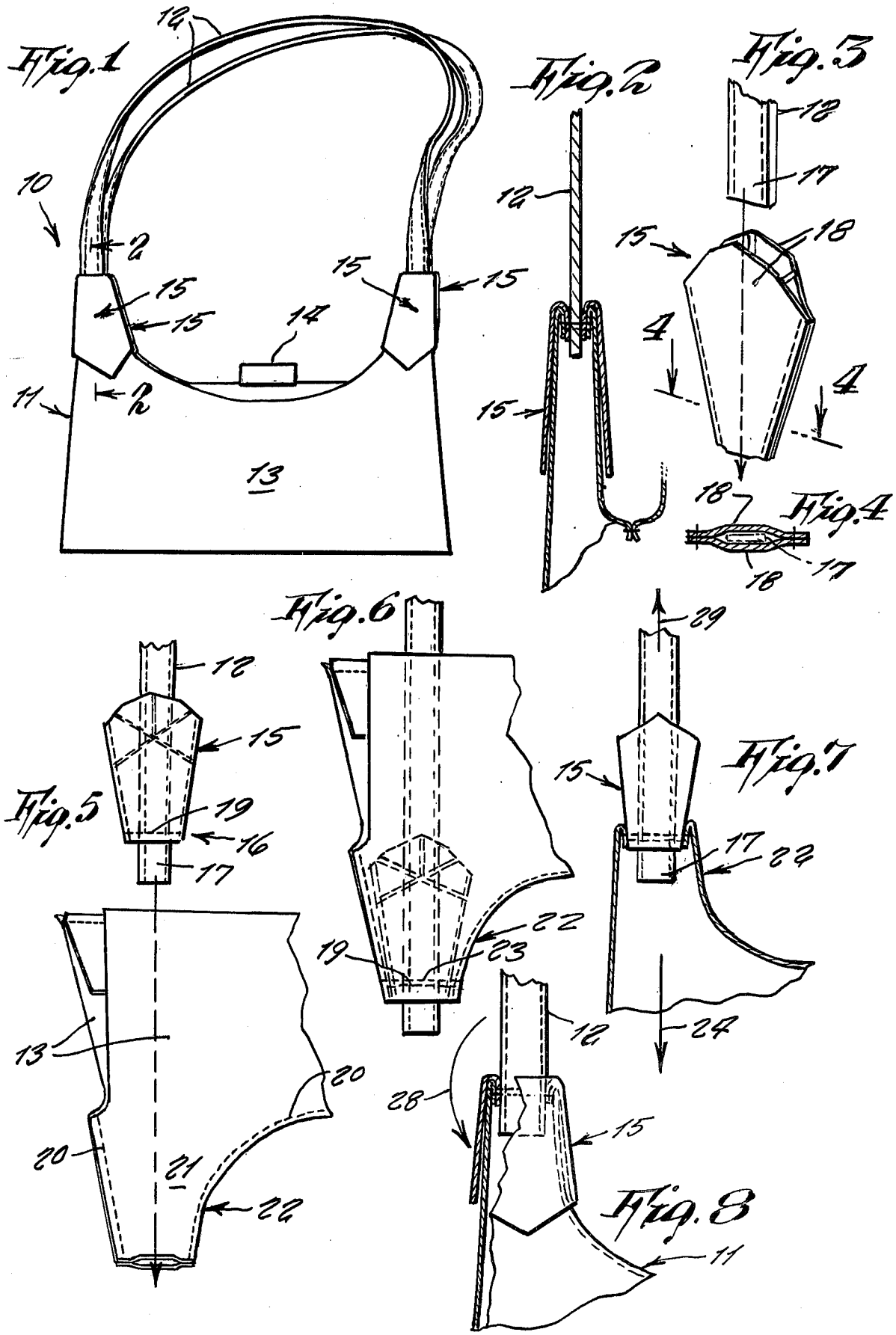
FIG. 1 is a side view of a lady's handbag incorporating the present invention.
FIG. 2 is an enlarged cross section on line 2—2 of FIG. 1.
FIG. 3 through FIG. 8 are views showing successive steps in the manufacture of the present invention in conjunction with the handbag.

Referring now to the drawing in greater detail, the reference numberal 10 represents a handbag according to the present invention in which there is a bag or bag body 11 to which there is permanently secured one or more straps 12 so that the bag can be conveniently carried by a person. The bag is generally made to include opposite side panels 13 that are stitched together at their peripheral side and bottom edges while the upper edges are secured to frames, not shown, that are pivotably attached together so to form a bag opening, and which is normally maintained closed together by a snap lock 14 so that personal objects may be carried securely in the bag.

In the example illustrated in the drawing, two straps 12 are connected to the bag.

In the present invention, a cuff 15 covers the connection 16 made between the bag and each end 17 of the strap, the cuff enclosing the mechanical connection so to add to the handbag's attractiveness.

The cuff is made and applied to the bag by the following process or method:

A cuff 15 is first made of two panels 18 of leather or other suitable material, and which are generally triangularly tapered in shape. The panels 18 are stitched together along opposite side edges so to form a tapering tube or cuff. The panels thus stitched, have a finished outer side thereof located on the inner side of the tube, at this time. In the manufacture process of the handbag, an end 17 of a strap is then inserted through the cuff with the strap end protruding out of a narrow end of the cuff. A stitch 19 transversely across a narrow end of the cuff secures it to the strap. The bag side panels 13 are positioned with other sides facing each other and sewn together with a peripheral stitch 20, each panel having extending, tapering portions 21 which are left unstitched at a terminal end so to form tapering tubular portions 22 inside each of which one of the strap ends 17 is inserted together with the attached cuff 15, as shown in FIGS. 5 and 6. A transverse stitch 23 then secures the inside-out bag to the strap end and its inside-out cuff.

Thereafter the bag is inverted right side out by pulling the bag and strap in opposite directions as indicated by arrows 24 in FIG. 7. Thereafter the cuff is inverted right side out by flipping it over as shown by arrow 28 in FIG. 8. Thus the flipped over cuff encloses the tubular portion 22 of the bag, as is clearly shown in FIG. 2. The stitches 19 and 23 are also thus hidden, in order to produce a pleasing design of handbag 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A handbag, comprising in combination a bag and at least one strap secured to said bag, said bag including a pair of opposite side panels peripherally stitched together except along an upper edge thereof fitted with interpivotable frames having a lock, and also being left unstitched at a terminal of a plurality of tapering portions, said tapering portions stitched together along their side edges forming tubular portions receiving the ends of said straps, and said tubular portions being each enclosed by a cuff draped around an outer side thereof providing an attractive appearance.

* * * * *